United States Patent [19]

Taravella

[11] Patent Number: 4,843,790

[45] Date of Patent: Jul. 4, 1989

[54] CASING TRIM

[75] Inventor: Salvatore R. Taravella, Buffalo, N.Y.

[73] Assignee: National Gypsum Company, Dallas, Tex.

[21] Appl. No.: 297,379

[22] Filed: Jan. 17, 1989

Related U.S. Application Data

[63] Continuation-in-part of Ser. No. 177,297, Apr. 4, 1988.

[51] Int. Cl.[4] ..... E06B 1/04

[52] U.S. Cl. ..... 52/211; 52/518; 52/60

[58] Field of Search ..... 52/211, 212, 287, 288, 52/716, 717, 730, 518, 60

[56] References Cited

U.S. PATENT DOCUMENTS

| | | | |
|---|---|---|---|
| 908,858 | 1/1909 | Goddard | 52/212 |
| 1,942,137 | 1/1934 | Connell | 52/287 |
| 3,139,703 | 7/1964 | Hilt | 52/211 X |
| 3,443,345 | 5/1969 | Spencer | 52/288 X |
| 4,189,885 | 2/1980 | Fritz | 52/288 X |
| 4,341,048 | 7/1982 | Minter | 52/716 X |
| 4,389,824 | 6/1983 | Anderson | 52/212 X |
| 4,407,100 | 10/1983 | Huelsekopf | 52/212 |
| 4,461,128 | 7/1984 | Knoebi | 52/94 |

*Primary Examiner*—Carl D. Friedman
*Assistant Examiner*—Jerrold D. Johnson
*Attorney, Agent, or Firm*—Laird F. Miller; Robert F. Hause

[57] ABSTRACT

A casing trim, and the combination therewith of a flat vinyl strip, and the method of concealing building wooden casings and the like, wherein the casing trim is nailed to the edge portion of a casing, with one flange of the casing trim extending over an edge of the casing, and the perpendicularly directed face portion has a channel which receives and retains an edge of the flat vinyl strip. In an added embodiment, the flat vinyl strip is replaced by a wide cap having a rearwardly extending flange, for engagement in a forwardly extending channel of a receiver, all of which are disposed around the edge of adjacent vinyl siding.

10 Claims, 3 Drawing Sheets

CASING TRIM

This is a continuation-in-part of Ser. No. 177,297, filed Apr. 4, 1988 Pending.

BACKGROUND OF THE INVENTION

This invention relates to trim elements for concealing portions of buildings, such as door and window casings, moldings, fascia boards and porch posts and particularly combinations of elements including scrap siding materials, to match the appearance of the concealing trim element with the siding appearance, during the process of applying thin, elongate siding to a home or other building.

U.S. Pat. No. 4,479,331 discloses the use of specially designed vinyl extrusions for concealing wood window sash, a concept which would require different extruded facings for each size and shape of sash.

U.S. Pat. No. 4,461,128 discloses a combination of a standard finish trim channel employed as a soffit panel supporting inner channel and a specially designed corner member, which elements cooperate to support a soffit panel. This specially designed corner member is nailed to the fascia, and is further specially designed to include means for receiving and holding the bottom edge of a fascia concealing panel.

U.S. Pat. No. 3,413,775 discloses a combination of cornices and substrates for providing a new facing over a column of rectangular cross section. The four flat substrates, or facings, are adhered to the column sidewalls, and the cornices each have a pair of perpendicularly directed channels, which receive and protect the vertical edges of the perpendicularly disposed facings. The cornices are held in place by their grasping of the facings' edges. The cornices are not fastened directly to the column.

SUMMARY OF THE INVENTION

The present invention provides a novel means and method for concealing those portions of a house, or other structure, which portions are not covered during application of thin elongate siding.

The invention employs an elongate vinyl casing trim, which is fastened along one elongate edge of a wooden substrate element. The novel casing trim includes an edge concealing flange, and, perpendicular thereto, a elongate channel which includes a rearwardly disposed nailing flange and a forwardly disposed front flange. This casing trim is nailed to the front face of the substrate element with the edge concealing flange concealing the edge of the substrate element.

An elongate edge of a flat strip, cut from elongate siding material, of any desired width, is inserted into the channel of the casing trim, so that the flat strip conceals the face of the substrate element. The opposite elongate edge of the flat strip can be held by a similar casing trim, or by any other means. The edge concealing flange is preferably formed with a plurality of elongate shallow grooves, permitting the use of a single form of casing trim on substrate elements of widely varying widths of substrate element edges, by breaking off portions of the edge concealing flange along any of the several shallow grooves.

In another embodiment of the invention, the face of the substrate element is concealed by an elongate cap which has a wide face portion. One edge of the face portion is inserted into the channel of the elongate casing trim and the other edge of the face portion is formed to extend beyond the substrate element and conceal the edges of a plurality of strips of siding. Spaced inwardly from the edge overlapping the siding is a rearwardly extending elongate flange. This flange is formed to extend into a forwardly extending channel on an elongate receiver. The receiver also includes a base, with a plurality of nailing holes, for disposition behind the edges of the siding, which edges are concealed by the edge of the cap face portion.

It is an object of the invention to provide an elongate casing trim for concealing the edge of an elongate structural element and simultaneously providing a perpendicularly directed elongate channel for receiving and retaining in place the side edge of an elongate sheet of facing material.

It is a further object to provide such a casing trim, made of elongate vinyl, for use in combination with elongate thin strips of vinyl which are cut from elongate strips of vinyl siding.

It is a further object to provide such a casing trim product which is readily modifiable for use on a relatively wide range of edge widths of substrate elements.

It is a further object to provide a three-piece window or door frame trim system to cover wood frames and the edges of adjacent thin elongate vinyl siding strips.

It is a still further object of the invention to provide a novel method for concealing a plurality of elongate structural elements.

BRIEF DESCRIPTION OF THE DRAWINGS

These and other objects and advantages of the invention will be more readily apparent when considered in relation to the preferred embodiments, as set forth in the specification, and shown in the drawings, in which.

DESCRIPTION OF THE PREFERRED EMBODIMENTS

Figure 1:
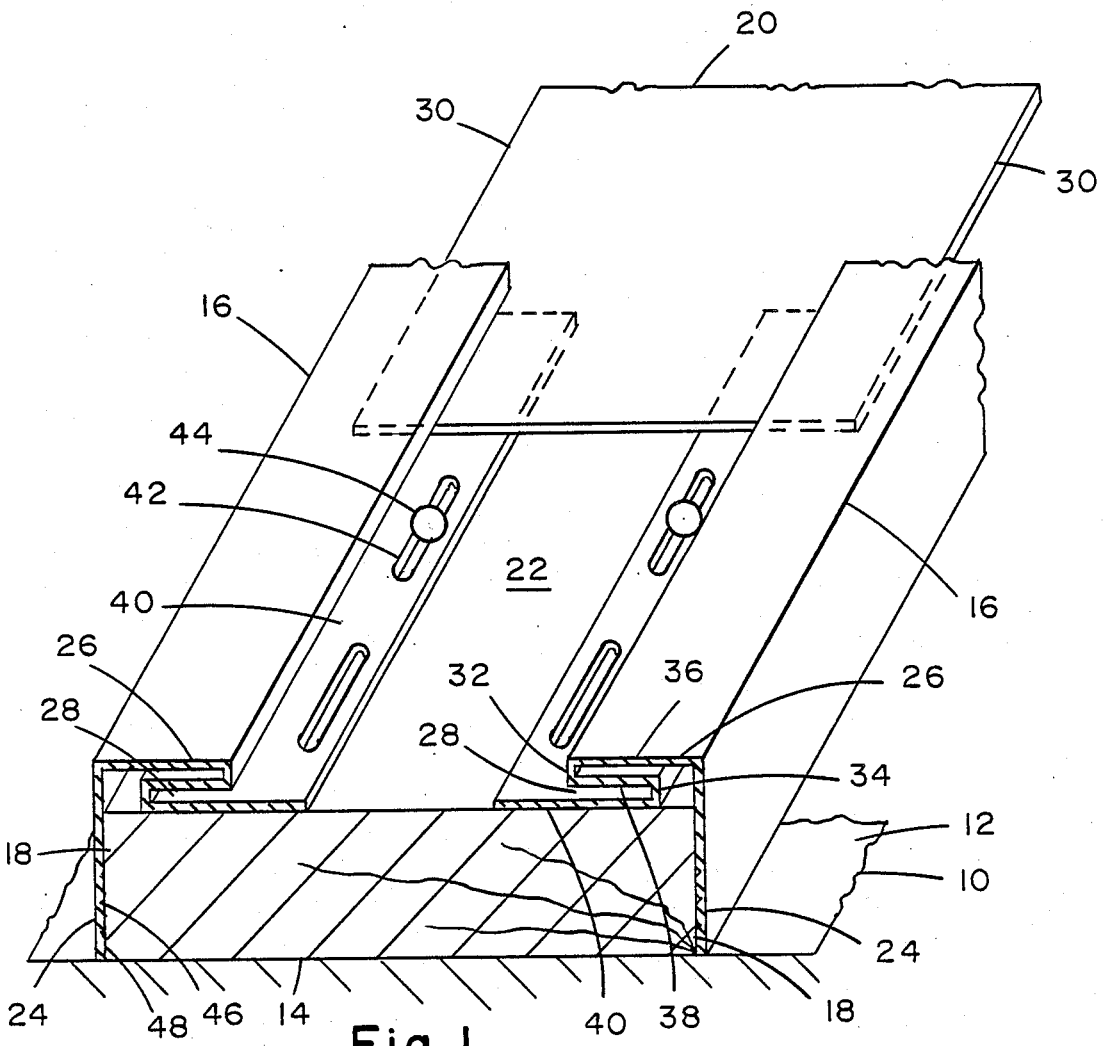
FIG. 1 is an isometric, sectional end view of a wooden window casing with a section of elongate casing trim nailed onto each front edge of the window casing and a flat sheet of vinyl in the process of being slid into the casing trim, in accordance with the invention.

Referring to FIG. 1, there is shown a wall 10, on the face 12 of which there is disposed an elongate, wide wooden casing 14. Face 12 may be a side of a home, to which thin elongate siding is being applied. Casing 14 is decoratively concealed, in accordance with the invention, by an elongate casing trim 16 nailed to casing 14 along each side edge 18 of casing 14, and an elongate thin flat vinyl strip 20, which may match, or even be made from scraps of, the thin elongate siding being applied, disposed over the face 22 of casing 14.

Each casing trim 16 includes an edge concealing flange 24 which is disposed along the surface of a side edge 18 of casing 14, and a face portion 26 which extends perpendicular to the edge concealing flange 24 and is disposed over the face 22 of casing 14, adjacent an edge thereof. The face portion 26 is formed to include an inwardly directed channel 28. The channels 28 of each of the two casing trims 16 are directed toward each other, and the flat strip 20 has two side edges 30 disposed respectively in the two channels 28.

In the structure of FIG. 1, the casing trims 16 are manufactured by a process known as postforming, wherein a flat strip of vinyl is extruded and immediately thereafter, before cooling and hardening, is folded along three elongate lines, forming the right angle between the edge concealing flange 24 and the face portion 26, and forming two 180° folds 32, 34, dividing the face portion 26 into three elongate portions, edge portion 36, intermediate portion 38 and the bottom flange 40. The channel 28 is between the intermediate portion 38 and the bottom flange 40. This postformed vinyl casing trim, once cooled, is relatively rigid.

The bottom flange 40, disposed against the casing face 22, has a plurality of lengthwise extending nail slots 42. Nails 44 affix the casing trim 16 to the casing 14.

A plurality of shallow, narrow parallel grooves 46 are formed in the inner surface 48 of the edge concealing flange 24. Grooves 46 make it readily possible to break off elongate portions of the edge concealing flange 24, so that a casing trim 16 with a relatively wide edge concealing flange 24 can be easily modified for use on wooden casing of relatively narrower edge dimension.

Figure 2:
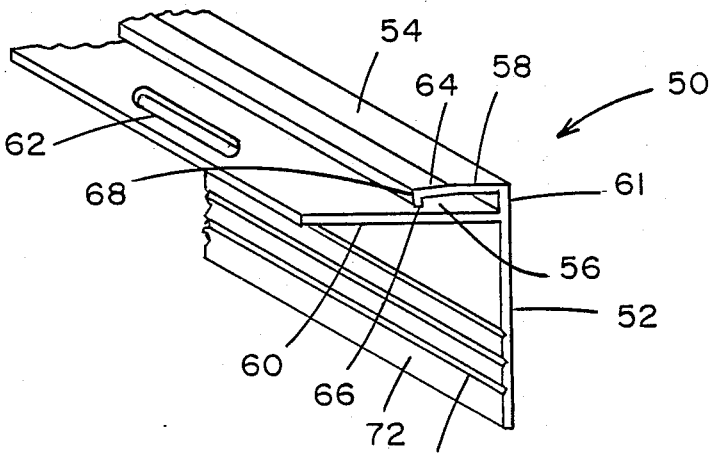
FIG. 2 is an isometric, end view of a modified section of elongate casing trim, also constructed for use in accordance with the invention.

Referring to FIG. 2, there is shown a modified form of casing trim 50, formed by extrusion of vinyl through a profiled die. Casing trim 50 includes an edge concealing flange 52, and a face portion 54 which extends perpendicular to the edge concealing flange 52. The face portion 54 is formed to include an inwardly directed channel 56, located between a relatively narrow top flange 58 and a relatively wide bottom flange 60, adjoined by a web 61. The bottom flange 60 has formed therein a plurality of lengthwise formed with a downwardly and inwardly angled portion 64 ending in a downwardly directed, small rib 66 at the downward and inward terminus 68. Rib 66 is provided to lay relatively tightly against a flat vinyl strip 20.

The casing trim 50 will be understood as suitable for use in receiving and retaining the side edges 30 of a flat strip 20, functioning essentially as a casing trim 16 functions in the structure of FIG. 1.

The edge concealing flange 52 of casing trim 50 has a plurality of shallow narrow parallel grooves 70 in the inner surface 72, adapted to function similar to the grooves 46 of casing trim 16.

Figure 3:
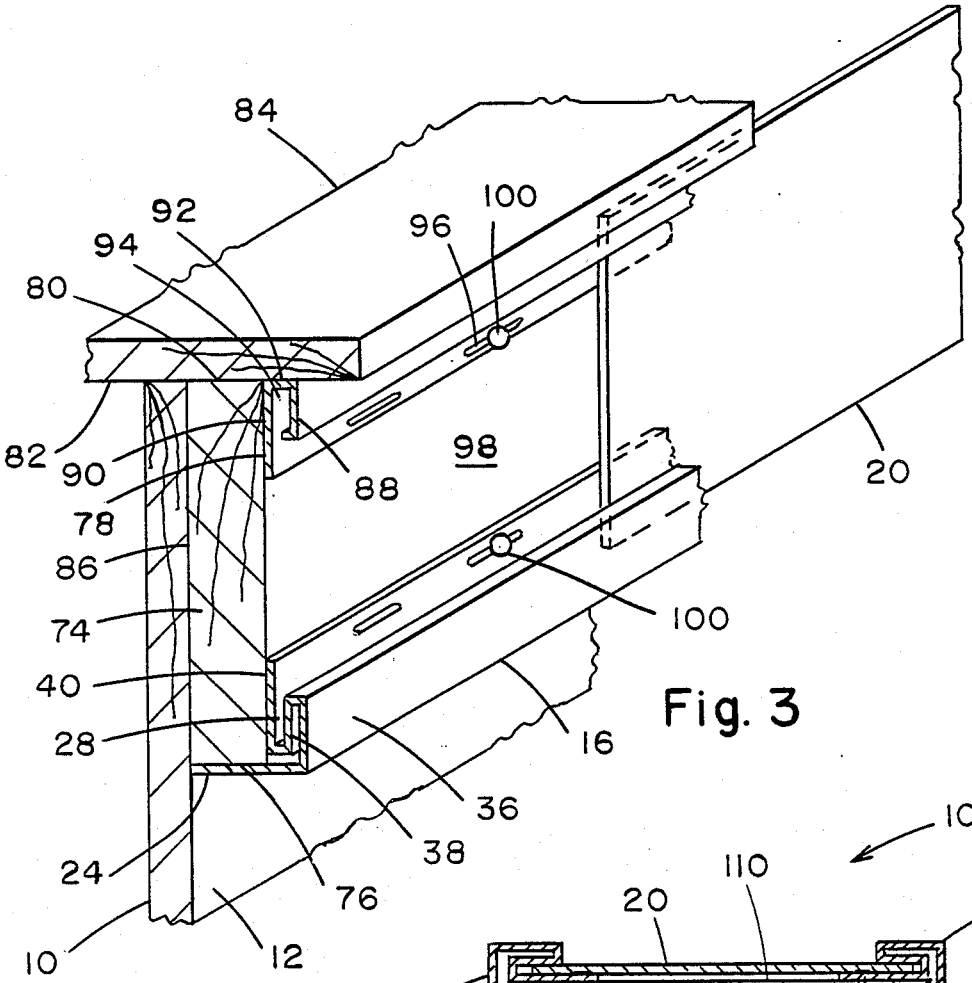
FIG. 3 is an isometric, sectional end view of a wooden gable fascia board abutting the bottom side of roof boards, with the novel casing trim at the bottom edge of the fascia board acting in combination with a standard finish trim channel to receive and retain an elongate flat sheet of vinyl.

In FIG. 3, there is shown a gable fascia board 74, the concealment of which involves the use of a casing trim 16 along the bottom edge 76 of the fascia board 74, and a downwardly opening channel member 78, with a flat vinyl strip 20 disposed and retained thereby. The structure of FIG. 3 is used wherever a wooden trim member has only one edge surface exposed, such as the bottom edge 76 of board 74. The top edge 80 of board 74 is located against the bottom surface 82 of roof boards 84. The gable fascia board 74 has a back surface 86 disposed against the face 12 of a wall 10.

The downwardly opening channel member 78 has a structure which includes a relatively narrow top flange 88 and a relatively wide bottom flange 90, adjoined by a web 92, forming therewithin a downwardly opening channel 94. Bottom flange 90 has a plurality of lengthwise extending nail slots 96.

Channel member 78 and casing trim 16 are both affixed to the face 98 of board 74 by nails 100.

Figure 4:
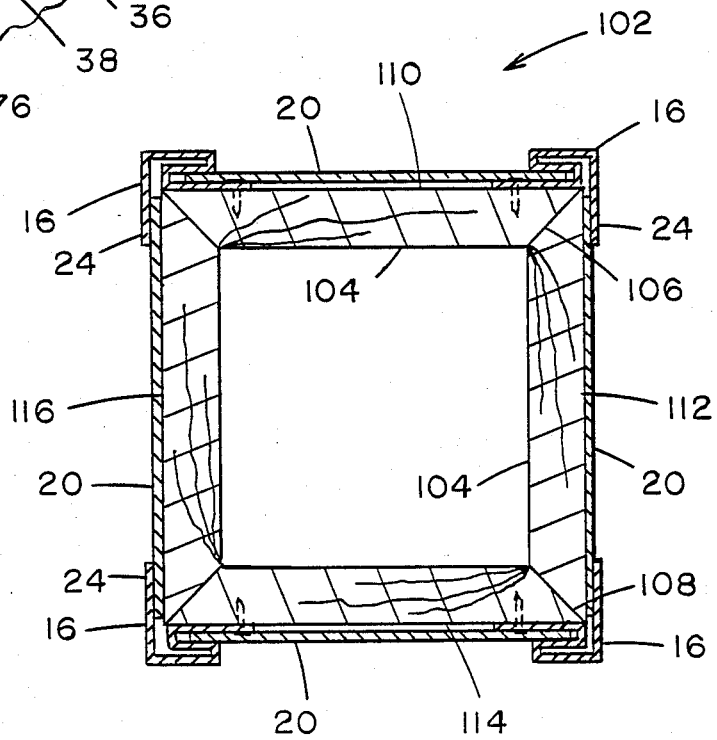
FIG. 4 is a sectional top view of a porch post with the four sides covered with elongate flat strips of vinyl which are retained in place by the use of four elongate casing trims, all in accordance with the invention.

FIG. 4 shows a porch post 102, constructed of four vertically extending wooden boards 104, adjoined at their edges 106 to form the corners 108 of post 102.

Two opposed sides 110 and 114 of post 102 are each concealed by a pair of casing trims 16 with a flat vinyl strip 20 retained therebetween. The other two opposed sides 112 and 116 are each concealed by a flat vinyl strip 20, each of which is disposed under and retained in place by the edge concealing flanges 24 of a pair of casing trims 16, located along the two edges of sides 112 and 116.

Figure 5:
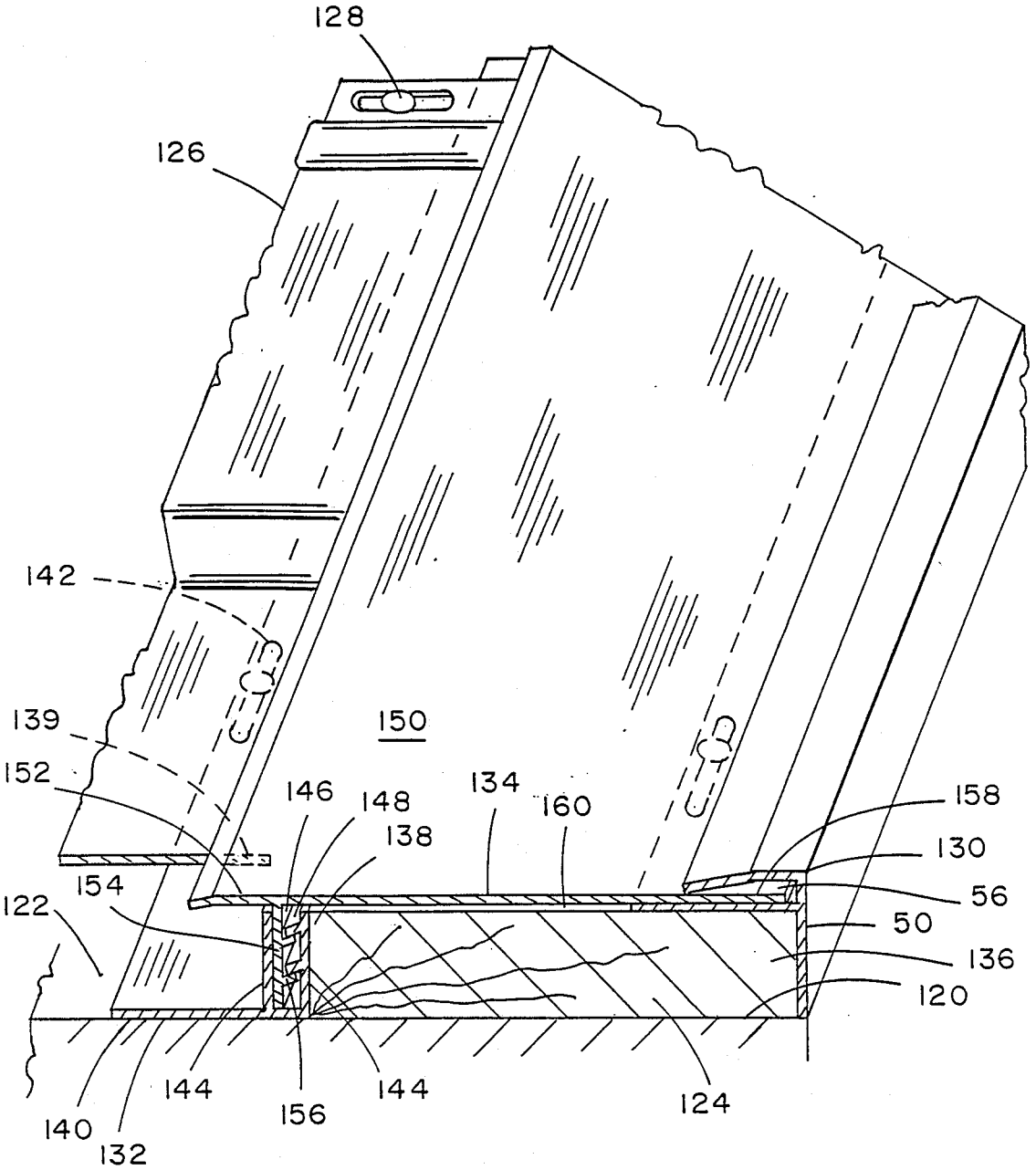
FIG. 5 is an isometric, sectional end view of a wooden window casing with a section of elongate casing trim nailed onto one front edge of the window casing, an elongate receiver nailed onto a base wall behind the vinyl siding adjacent the second edge of the window casing and an elongate cap having one edge engaged in said casing trim and a second edge extending over the vinyl siding, with a rearward flange engaged in a channel of the receiver.

FIG. 5 shows an embodiment of the invention wherein a wall 120, on the face 122 of which there is disposed an elongate, wooden, 1 in.×4 in., window casing 124. Disposed over face 122 are a plurality of strips of thin vinyl lap siding 126 which is attached by nails 128 to face 122.

The wooden window casing 124 is decoratively concealed, in accordance with the invention, by a three-piece casing trim system 130. The three-piece system 130 includes elongate casing trim 50, elongate receiver 132, and elongate cap 134.

The elongate casing trim 50 is nailed to casing 124 along the right side edge 136 thereof. The elongate receiver 132 is nailed onto face 122 of wall 120 adjacent the casing left side edge 138, and behind the ends 139 of the strips of vinyl siding 126.

The elongate casing trim 50 has a channel 56 which opens toward the left. The receiver 132 consists of a base 140 with nail holes 142, and extending perpendicularly forwardly from base 140 are two flanges 144 forming a forwardly opening channel 146. The channel 146 has inwardly directed ridges 148 therewithin.

Elongate cap 134 consists of a wide thin face 150. Located near the left edge 152 of face 150, but spaced inwardly therefrom is a rearwardly extending elongate leg 154, with sidewardly directed ridges 156 thereon. The leg 154 extends into the channel 146 of receiver 132. The ridges 148 in channel 146 engage the ridges 156 on leg 154, holding leg 154 within channel 146.

The right edge 158 of cap face 150 extends into the channel 56 and is held therein. The left edge 152 of face 150 extends over the ends 139 of the siding 126, concealing the ends 139. The balance of face 150 conceals the face 160 of casing 124.

Having completed a detailed disclosure of the preferred embodiments of my invention, so that others may practice the same, I contemplate that variations may be made without departing from the essence of the invention.

I claim:

1. A casing trim system comprising an elongate cap, and edge receiving elongate casing trim element and an elongate receiver, said casing trim element comprising an edge wall and a pair of flanges forming an elongate channel opening in a direction away from said edge wall whereby an edge of said elongate cap may be retained therein, said receiver comprising a base and elongate means extending away from said base for engaging said cap, and said cap comprising a relatively wide face and elongate means extending rearwardly for engaging and being held in place by said retainer, said rearwardly extending means being spaced inwardly from one side edge of said cap face sufficient to permit said one side edge to conceal edges of vinyl siding when said cap is placed over the face of a wooden casing.

2. A casing trim system as defined in claim 1 wherein said edge receiving casing trim element edge wall consists essentially of a casing edge concealing flange.

3. A casing trim system as defined in claim 1 wherein said receiver consists essentially of a base and a pair of perpendicularly extending flanges.

4. A casing trim system as defined in claim 3 wherein said rearwardly extending elongate means on said cap consists essentially of an elongate leg suitable for insertion between said flanges of said base.

5. A casing trim system as defined in claim 4 wherein said base flanges and said cap leg have interlocking ridges for retaining said leg between said flanges.

6. A casing trim system as defined in claim 1 wherein said edge receiving trim element has a plurality of nailing holes in one of said flanges and said receiver base has a plurality of nailing holes therein.

7. In combination, a wooden casing for a door or window opening, a building wall on which said casing is affixed, a plurality of strips of vinyl siding affixed to said wall extending away from said casing, and a casing trim system concealing said casing and a small portion of said adjacent siding, said casing trim system consisting essentially of an elongate edge receiving casing trim element, an elongate cap having an edge extending into and retained by said edge receiving trim element, and a receiver, said receiver comprising a base, said base being nailed to said building wall adjacent said wooden casing, said receiver further comprising means for receiving and holding a rearward element on said cap, said cap comprising a wide thin face including said edge retained by said edge receiving trim element, said cap further comprising an opposite edge which conceals said small portion of said siding, said cap further comprising said rearward element which is held by said receiver, said rearward element and said receiver holding means being disposed between said wooden casing and said vinyl siding.

8. In the combination of claim 7, said receiver holding means and said cap rearward element consisting of a leg on one element inserted and held within a channel on the other of said elements.

9. In the combination of claim 8, the further provision of interlocking ridges on said leg and said channel.

10. In the combination of claim 7, an elongate edge receiving casing trim element having an elongate edge concealing flange and an elongate face portion extending perpendicularly from one edge of said edge concealing flange, said face portion having a relatively wide bottom flange and elongate means in parallel spaced in relation to said bottom flange, said elongate cap having an edge retained between said bottom flange and said parallel spaced elongate means.

* * * * *

UNITED STATES PATENT AND TRADEMARK OFFICE

CERTIFICATE OF CORRECTION

PATENT NO. : 4,843,790

DATED : July 4, 1989

INVENTOR(S) : Salvatore R. Taravella

It is certified that error appears in the above-identified patent and that said Letters Patent is hereby corrected as shown below:

Col. 3, line 50: Insert after the word "lengthwise" and before the word "formed" --extending nail slots 62. The top flange 58 is preferably--.

Col. 4, line 65: Insert after the word "system" and before the word "comprising" --for use with wooden casings and vinyl siding--.

Col. 4, line 66: The word "and" should read --an--.

Signed and Sealed this

Twenty-second Day of May, 1990

*Attest:*

HARRY F. MANBECK, JR.

*Attesting Officer*

*Commissioner of Patents and Trademarks*